US008721353B2

(12) United States Patent
Xu et al.

(10) Patent No.: US 8,721,353 B2
(45) Date of Patent: May 13, 2014

(54) FOUR IN ONE ELECTRICAL CONNECTOR SOCKET

(71) Applicant: Advanced-Connectek Inc., New Taipei (TW)

(72) Inventors: Fu Yi Xu, New Taipei (TW); Wei Wan, New Taipei (TW); Shu Lin Duan, New Taipei (TW); Hua Yan Wu, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 63 days.

(21) Appl. No.: 13/678,950

(22) Filed: Nov. 16, 2012

(65) Prior Publication Data

US 2014/0024261 A1 Jan. 23, 2014

(30) Foreign Application Priority Data

Jul. 20, 2012 (CN) ..... 2012 1 0252772

(51) Int. Cl.
*H01R 13/648* (2006.01)

(52) U.S. Cl.
USPC ..... 439/108; 439/660; 439/607.35; 439/489

(58) Field of Classification Search
USPC ..... 439/607.35, 607.36, 607.38, 607.4, 439/660, 108, 489
See application file for complete search history.

(56) References Cited

U.S. PATENT DOCUMENTS

| | | | | |
|---|---|---|---|---|
| 7,744,426 | B2 * | 6/2010 | Zheng et al. | 439/660 |
| 7,841,905 | B2 * | 11/2010 | Zheng et al. | 439/660 |
| 2010/0261385 | A1 * | 10/2010 | Zheng et al. | 439/607.01 |
| 2012/0302096 | A1 * | 11/2012 | Ellison | 439/607.05 |

* cited by examiner

*Primary Examiner* — Gary Paumen
(74) *Attorney, Agent, or Firm* — Rabin & Berdo, P.C.

(57) ABSTRACT

An electrical connector socket includes a casing, a main body received in the casing, a first power contact terminal one distal end of which is mounted inside the power transmission body, a first power detect terminal, a second power detect terminal, a second power contact terminal, a ground terminal, upper terminals, lower terminals, an upper enclosure provided to enclose the bents of the upper terminals and a lower enclosure provided to enclose the bents of the lower terminals and to combine with the upper enclosure.

6 Claims, 5 Drawing Sheets

FOUR IN ONE ELECTRICAL CONNECTOR SOCKET

CROSS-REFERENCE TO RELATED APPLICATION

This application claims priority from application No. 201210252772.5, filed on Jul. 20, 2012 in the State Intellectual Property Office of The People's Republic of China.

FIELD OF THE INVENTION

The invention relates to an electrical connector socket and, more particularly, to a four-in-one electrical connector socket to integrate functions of power, USB2.0, USB3.0 and MiNi DP one device.

BACKGROUND OF THE INVENTION

In order to accomplish the designated purposes, nowadays, data transmission or electrical signals are transmitted via electrical connector socket of different types. Functionally, electrical connector sockets are divided into electrical connector socket and signal transmission connector such as USB2.0 USB3.0 and MiNi DP.

With reference to FIG. 1, a conventional electricity connector 7 is composed of a casing, an insulation frame 71 securely received inside the casing 70 and a main frame 72 also securely received inside the insulation frame 71 and having a power transmission unit 720 installed inside the main frame 72 and provided with four transmission terminals 7200. This kind of connector is bulky and not very handy when it comes to application.

Universal Serial Bus; USB, is a standard connector used between a computer system and an exterior device, also an interface technology standard for input/output. This device is widely used in personal computers and mobile devices such as smart phones, personal data assistant; PDA and the like. It is even expanded to recording equipment, digital TVs, video games and others.

As the advance of modern technology and the increasingly increased demand for high transmission speed and high storage capacity, the transmission speed of USB 1.0 (Max Speed 12 Mbps) is now upgraded to USB2.0 with a transmission speed of 480 Mbps. Currently, the most updated version USB3.0 has a transmission speed of 5 Gps to satisfy users' requirements in time and speed when a large chunk of files occupied a large amount of space are being sent simultaneously.

MiNi DP, which was issued by Apple™ on Oct. 14, 2008, is a micro version of display port for support of Mac Book (replacing the conventional Mini-DVI), MacBook Air (replacing the conventional Micro-DVI) and Mac Book Pro computers (replacing the conventional DVI). In all these conventional computers, the input and output of the connectors are individually manufactured and assembled, which unnecessarily increases a space in the electronic devices for accommodation of ports for the output and/or input and makes the electronic devices bulky. Adding spaces in the electronic devices also increases the cost for structure molding, which is definitely a bad influence for market compatibility.

SUMMARY OF THE INVENTION

The primary objective of the present invention is to provide an electrical connector socket which involves fewer components and less cost.

A main objective of the present invention is to provide a four-in-one electrical connector socket which is able to transmit power and data transmission.

In order to accomplish the aforementioned objective, the electrical connector socket of the preferred embodiment of the present invention includes:

a casing;

a main body received in the casing and having:

a power transmission body;

a ground next to the power transmission body; and an extension next to the ground;

a first power contact terminal one distal end of which is mounted inside the power transmission body;

a first power detect terminal one distal end of which is mounted inside the power transmission body;

a second power detect terminal one distal end of which is mounted inside the power transmission body and the other distal end of which is connected to the other end of the first power detect terminal;

a second power contact terminal one distal end of which is mounted inside the power transmission body;

a ground terminal one end of which is mounted inside the ground;

upper terminals one ends of which are mounted in the extension and the other ends of which are respectively provided with a bent, wherein every two upper terminals are arranged with one ground terminal to reduce cross influences among the upper terminals;

lower terminal one end of which are mounted in the extension and the other ends of which are respectively provided with a bent, wherein every two lower terminals are arranged with one ground terminal to reduce cross influences among the lower terminals;

an upper enclosure provided to enclose the bents of the upper terminals; and a lower enclosure, normally a dip type, provided to enclose the bents of the lower terminals and to combine with the upper enclosure.

It is to be noted from the objectives of the preferred embodiment of the present invention that the insulation body received in the metal body is no longer needed, which saves a lot of space and also simplifies the entire structure.

DETAILED DESCRIPTION OF THE INVENTION

Figure 1:
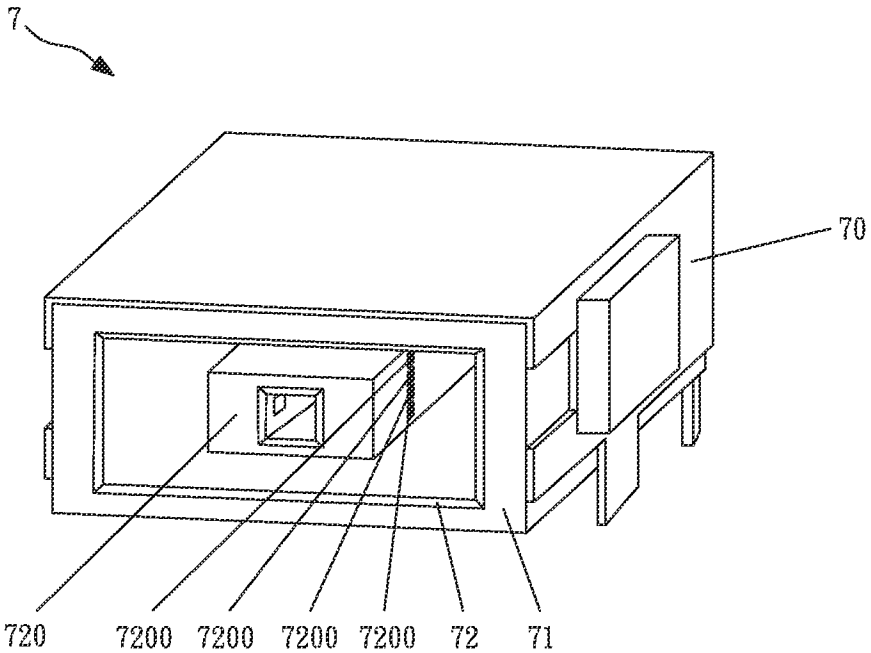
Fig. 1 (prior art)
FIG. 1 is a perspective view of the conventional electrical connector socket.
Figure 2:
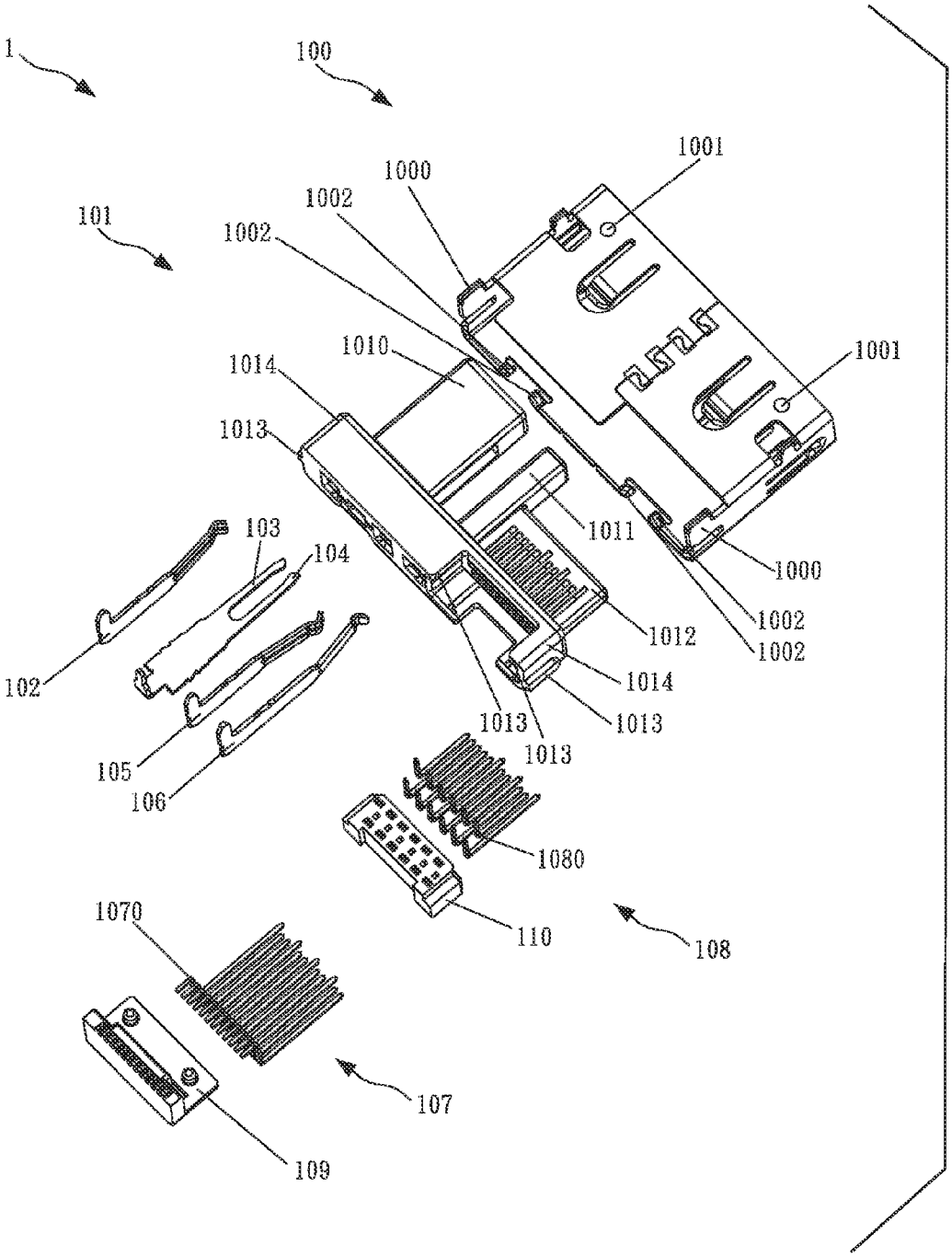
FIG. 2 is an exploded perspective view of an electrical connector socket of embodiment of the present invention.
Figure 3:
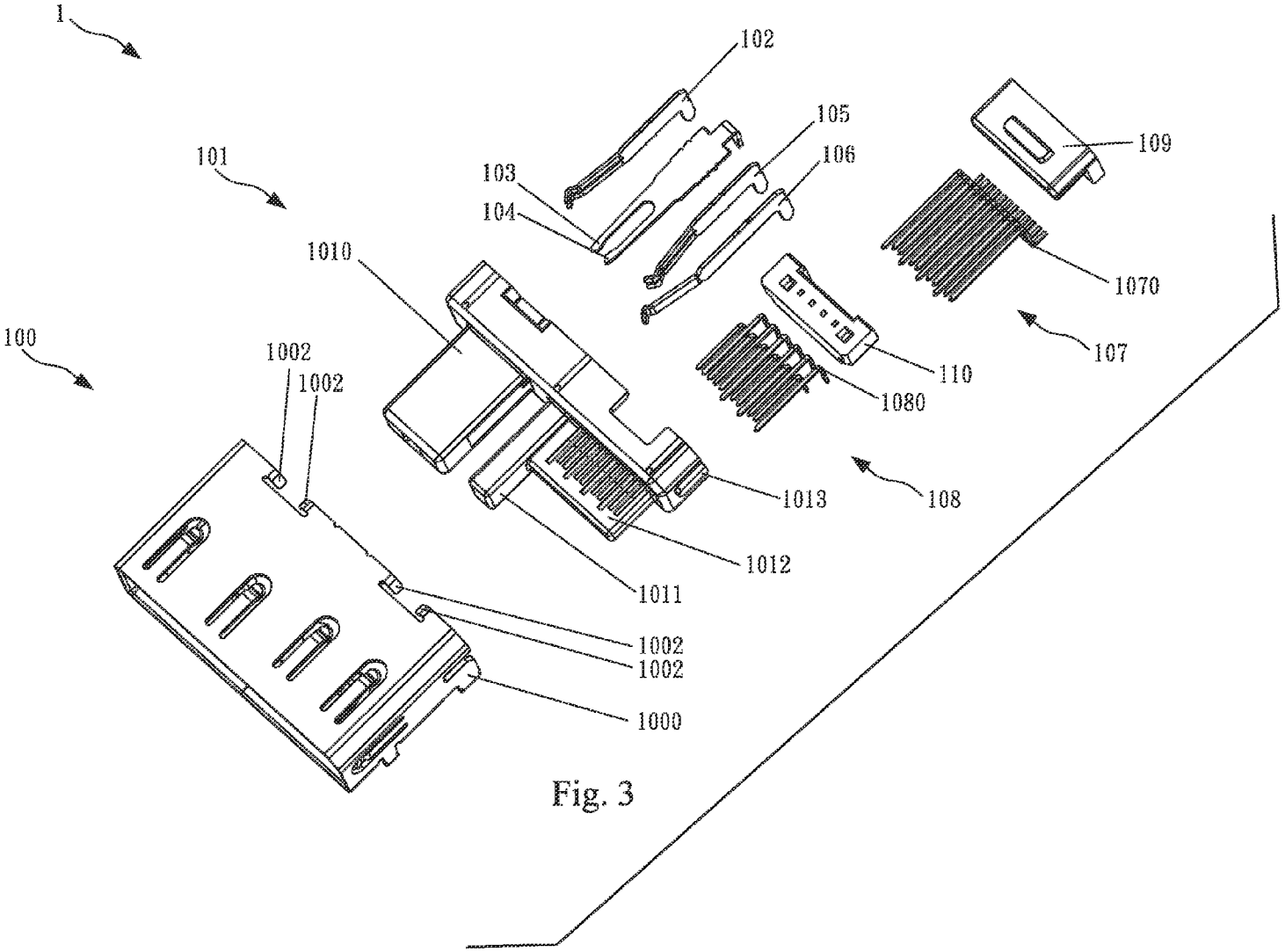
FIG. 3 is still an exploded perspective view of the electrical connector socket shown in FIG. 2.

With reference to FIGS. 2 and 3, the electrical connector socket 1 constructed in accordance with the preferred embodiment of the present invention is composed of:

a casing 100;

a main body 101 received in the casing 100 and having:

a power transmission body 1010;

a ground 1011 next to the power transmission body 1010; and an extension 1012 next to the ground 1011;

a first power contact terminal 102 one distal end of which is mounted inside the power transmission body 1010;

a first power detect terminal 103 one distal end of which is mounted inside the power transmission body 1010;

a second power detect terminal 104 one distal end of which is mounted inside the power transmission body 1010 and the other distal end of which is connected to the other end of the first power detect terminal 103;

a second power contact terminal 105 one distal end of which is mounted inside the power transmission body 1010;

a ground terminal 106 one end of which is mounted inside the ground 1011;

upper terminals 107 one ends of which are mounted in the extension 1012 and the other ends of which are respectively provided with a bent 1070, wherein every two upper terminals are arranged with one ground terminal 106 to reduce cross influences among the upper terminals;

lower terminals 108 one end of which are mounted in the extension 1012 and the other ends of which are respectively provided with a bent 1080, wherein every two lower terminals 108 are arranged with one ground terminal 106 to reduce cross influences among the lower terminals;

an upper enclosure 109 provided to enclose the bents 1070 of the upper terminals 107; and a lower enclosure 110, normally a dip type, provided to enclose the bents 1080 of the lower terminals 108 and to combine with the upper enclosure 109.

Figure 4:
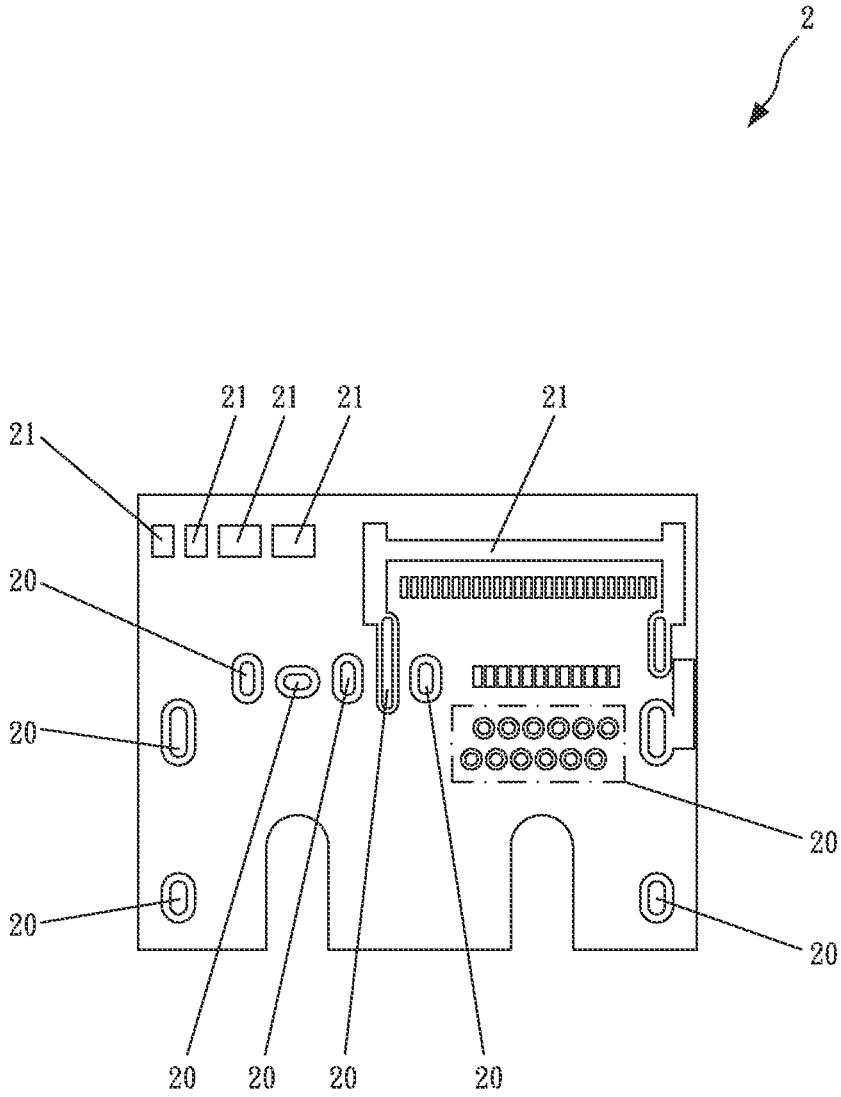
FIG. 4 is a plan view of a printed circuit board.

With reference to FIGS. 2 and 4, it is noted that the electrical connector socket of the preferred embodiment of the present invention may be combined with a printed circuit board (PCB) 2. The PCB 2 is provided with multiple welding positions 20 and lead positions 21. The welding positions 20 are provided to connect to the first power contact terminal 102, the first power detect terminal 103, the second power detect terminal 104, the second power contact terminal 105, the ground terminal 106, the upper terminals 107, and the lower terminals 108 via surface mounting technology (SMT). The lead positions 21 are provided for the formation of leads.

The ground terminal 106 can also be used to effectively avoid electromagnetic interference (EMI) among terminals when used in the first power contact terminal 102, the first power detect terminal 103, the second power detect terminal 104, the second power contact terminal 105, the ground terminal 106, the upper terminals 107, and the lower terminals 108. The maximum current that can be transmitted by the first power contact terminal 102, the first power detect terminal 103, the second power detect terminal and the second power contact terminal 105 is seven (7) ampere. The provision and mounting of the ground 1011 on the main body 101 greatly enhance the strength and durability.

In one preferred embodiment of the present invention, the upper terminals 107 and the lower terminals 108 respectively have ground terminals 106 to separate every two terminals in the upper terminals 107 and the lower terminals 108 such that when the upper terminals 107 and the lower terminals 108 are mounted on the main body 101, the two terminals of the upper terminals 107 correspond to one of the ground terminals 106 of the lower terminals 108 and vice versa. That is, the terminals of the upper terminals 107 are crisscross arranged relative to the terminals of the lower terminals 108. The bents 1070, 1080 of the upper terminals 107 and the lower terminals 108 respectively are made via insert molding. The upper terminals 107 and the lower terminals 108 are able to transmit signals of USB2.0, USB3.0 and MiNi DP.

In one preferred embodiment of the present invention, the other ends of the first power contact terminal 102, the first power detect terminal 103, the second power detect terminal and the second power contact terminal 105 and the ground terminals 106 are dip type so as to save space in the PCB2. Also, two sides of each of the first power contact terminal 102, the first power detect terminal 103, the second power detect terminal and the second power contact terminal 105 and the ground terminals 106 are provided with two triangular bosses to allow the first power contact terminal 102, the first power detect terminal 103, the second power detect terminal and the second power contact terminal 105 and the ground terminals 106 to have better grip on the main body 101. In addition, all the terminals mentioned above are made via riveting to maintain simplicity and stableness of the elements.

In still another embodiment of the present invention, on the two opposite sides and at least on the top side of the main body 101, there is at least one rib 1013 formed on the side wall thereof (two are shown) to enhance the assembly strength between the main body 101 and the casing 100. An ear 1014 is formed on two opposite sides of the main body 101 to correspond to a U-shaped guide track 1000 defined in two opposite sides of the casing 100. With the ear 1014 received in the corresponding U-shaped guide trace 1000, the main body 101 is securely mated with the casing 100. There are multiple rivet positions 1002 formed in the casing 100 to ease the assembly between the main body 101 and the casing 100.

Still, the casing 100 has multiple snap plates (not numbered) to ensure the engagement force when the connector of the preferred embodiment is used as a power socket. Among the snap plates, one of which is used as ground to help avoid electromagnetic interference. A boss 1001 is formed on two opposite sides of the bottom face of the casing 100 to prevent forward inclination when the electrical connector socket is experiencing SMT. The upper enclosure 109 further has two columns 1090 to correspond to two holes 1100 defined in the lower enclosure 110 such that the upper enclosure 109 can be securely combined with the lower enclosure 110.

Figure 5:
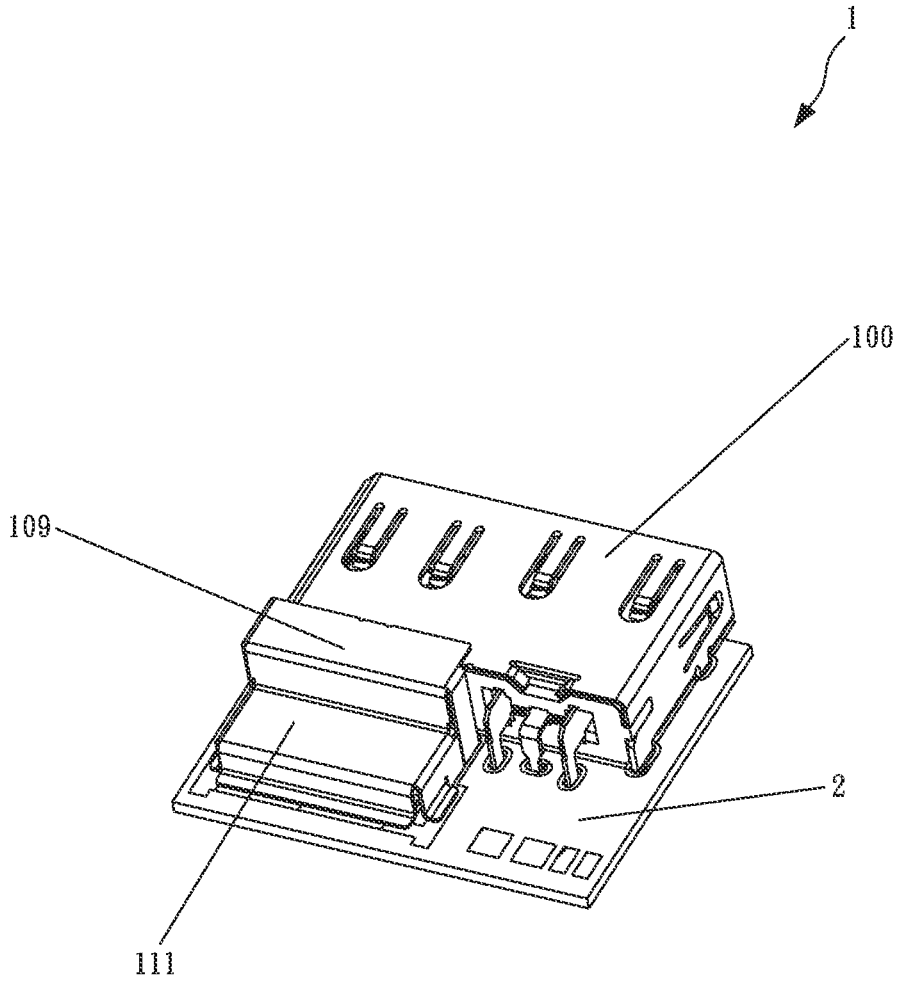
FIG. 5 is a perspective view showing that the electrical connector socket of the present invention is assembled on the printed circuit board.

With reference to FIGS. 2 and 5, a protection cover 111 is welded on the back of the combination of the upper enclosure 109 and the lower enclosure 110 and is securely mounted on lead positions 21 of the PCB 2 as well as the casing 100 via SMT. The provision of the protection cover 111 to entirely enclose the upper terminals 107 and the lower terminals 108 to avoid any signals going out to interference devices nearby.

With the introduction, it is learned that the electrical connector socket of the present invention, the structure is simple, light, with high compatibility and compact. Not only the electrical connector socket of the preferred embodiment keeps its original power transmission advantage, can it also transmit high frequency signals of USB2.0, USB3.0 and MiNi DP.

With the removal of the insulation frame of the conventional structure, direct mounting of the main body 101 into the casing 100 and only two terminals formed on the side of the main body 101, the overall volume is reduced, the thickness thereof is reduced and the material used is lessened and therefore the structure is simple yet durable.

It is to be noted that although the preferred embodiment of the present invention has been described, other modifications, alterations or minor change to the structure should still be within the scope defined in the claims. As those skilled in the art will readily observe that numerous modifications and alterations of the device and method may be made while retaining the teachings of the invention.

What is claimed is:

1. An electrical connector socket comprising:

a casing;

a main body received in the casing and having:

a power transmission body;

a ground next to the power transmission body; and an extension next to the ground;

a first power contact terminal one distal end of which is mounted inside the power transmission body;

a first power detect terminal one distal end of which is mounted inside the power transmission body;

a second power detect terminal one distal end of which is mounted inside the power transmission body and the other distal end of which is connected to the other end of the first power detect terminal;

a second power contact terminal one distal end of which is mounted inside the power transmission body;

a ground terminal one end of which is mounted inside the ground;

upper terminals one ends of which are mounted in the extension and the other ends of which are respectively provided with a bent, wherein every two upper terminals are arranged with one ground terminal to reduce cross influences among the upper terminals;

lower terminals one end of which are mounted in the extension and the other ends of which are respectively provided with a bent, wherein every two lower terminals are arranged with one ground terminal to reduce cross influence among the lower terminals;

an upper enclosure provided to enclose the bents of the upper terminals; and a lower enclosure provided to enclose the bents of the lower terminals and to combine with the upper enclosure.

2. The electrical connector socket as claimed in claim 1, wherein the upper terminals are crisscross arranged relative to the lower terminals.

3. The electrical connector socket as claimed in claim 1, wherein the bents of the upper terminals and the lower terminals respectively are made via insert molding.

4. The electrical connector socket as claimed in claim 1, wherein a rib is formed on at least on two opposite sides and a top side of the main body.

5. The electrical connector socket as claimed in claim 1, wherein an ear is formed on two opposite sides of the main body to correspond to a U-shaped guide track defined in two opposite sides of the casing to allow secured engagement between the main body and the casing.

6. The electrical connector socket as claimed in claim 1, wherein a protection cover is provided to enclose the upper terminals and the lower terminals entirely and mounted on a circuit board via surface mounting technology.

* * * * *